US005441361A

United States Patent [19]

Campbell

[11] Patent Number: 5,441,361

[45] Date of Patent: Aug. 15, 1995

[54] FIELD CONVERTIBLE APPARATUS FOR CONDUCTING EITHER FRONT LOAD ROAD PLANING OPERATION OR COLD IN-PLACE RECYCLING OPERATION

[75] Inventor: Thomas R. Campbell, Chattanooga, Tenn.

[73] Assignee: Astec Industries, Inc., Chattanooga, Tenn.

[21] Appl. No.: 168,876

[22] Filed: Dec. 17, 1993

[51] Int. Cl.[6] ..... E01C 23/12

[52] U.S. Cl. ..... 404/90; 404/92; 404/91; 366/20

[58] Field of Search ..... 404/72, 75, 90, 92, 404/91, 93, 94; 366/20, 22, 23, 25

[56] References Cited

U.S. PATENT DOCUMENTS

| | | | |
|---|---|---|---|
| 2,201,493 | 5/1940 | Jorgensen . | |
| 3,843,274 | 10/1974 | Gutman et al. | 404/91 |
| 4,139,318 | 2/1979 | Jakob et al. | 404/90 |
| 4,186,968 | 2/1980 | Barton | 299/39 |
| 4,193,636 | 3/1980 | Jakob | 299/39 |
| 4,317,642 | 3/1982 | Wirtgen | 404/91 |
| 4,342,485 | 8/1982 | Tuneblom | 299/39 |
| 4,723,867 | 2/1988 | Wirtgen | 404/90 |
| 4,826,352 | 5/1989 | Wirtgen | 404/90 |
| 4,946,307 | 8/1990 | Jakob | 404/91 |
| 5,078,540 | 1/1992 | Jakob et al. | 404/90 |

OTHER PUBLICATIONS

Roadtec, an Astec company, brochure No. RX 59, ©1990 Roadtec.

Roadtec, an Astec company, brochure No. RX-60, 5/1992 Corporate Graphics.

*Primary Examiner*—David J. Bagnell
*Assistant Examiner*—Pamela A. O'Connor
*Attorney, Agent, or Firm*—Nilles & Nilles

[57] ABSTRACT

A roadworking machine can be converted from front load road planing capability to cold in-place recycling capability by replacing the secondary conveyor on the front end of the machine with a mixer such as a standard pugmill. The machine can be converted in the field simply by detaching the conveyor from a-mounting assembly on the chassis and by attaching the pugmill to the same mounting assembly. The conveyor and pugmill are preferably attachable to the mounting assembly so as to be pivotable with respect to the chassis about both vertical and horizontal axes. The machine as thus constructed permits considerable versatility in both the discharge of milled materials from the secondary conveyor during front load planing and the discharge of recycled materials from the mixer during cold in-place recycling.

22 Claims, 8 Drawing Sheets

FIELD CONVERTIBLE APPARATUS FOR CONDUCTING EITHER FRONT LOAD ROAD PLANING OPERATION OR COLD IN-PLACE RECYCLING OPERATION

BACKGROUND OF THE INVENTION

1. Field of the Invention

The invention relates to roadworking machines and, more particularly, relates to roadworking machines capable of milling at least an upper layer of a roadway surface for transport from a work site or for cold in-place recycling.

2. Discussion of the Related Art

Milling machines are well known for planing the surface of a roadway. One such machine is disclosed in U.S. Pat. No. 4,139,318 to Jakob et al. (the Jakob patent). The milling machine disclosed in the Jakob patent includes a chassis, a planer or milling assembly, and a reclaimer assembly. The planer assembly includes a rotating cutter drum for removing the upper layer of the roadway surface and a floating moldboard which is yieldingly forced into contact with the roadway to the rear of the cutter drum. The reclaimer assembly includes a primary conveyor which extends forwardly from the cutter drum to the front of the chassis and which empties into a secondary conveyor extending forwardly and upwardly from the front of the primary conveyor. The secondary conveyor transports removed roadway materials from the primary conveyor to a dump truck or the like for transport to either 1) a landfill or the like for disposal, or 2) an asphalt plant for recycling.

Cold in-place recycling is becoming increasingly popular for the on-the-spot recycling of roadway paving materials. The typical cold in-place recycling operation involves the removal of the top layer of a roadway surface, the mixing of the removed materials with liquid asphalt, and the depositing of the mixture back onto the roadway surface. The system disclosed by the Jakob patent, while functioning well as a front load road planing machine, is generally thought to be incapable of cold in-place recycling because it is designed to travel forwardly during the milling operation and thus, if used in a cold in-place recycling system, would run over the recycled materials laid down by the system.

A roadworking machine capable of conducting a front load road planing operation and of forming part of a cold in-place recycling system is manufactured by Astec Corporation of Chattanooga, Tenn. under the Model No. RX60. The Astec RX60 machine differs from that disclosed in the Jakob patent primarily in that it has both front and rear moldboard assemblies each of which is independently raisable and lowerable. The rear moldboard is lowered and the front moldboard raised for a front load road planing operation in which the vehicle travels in the reverse direction to discharge materials into a dump truck or the like, and the rear moldboard is raised and the front moldboard lowered for a cold in-place recycling operation in which the vehicle travels in a forward direction to discharge materials into a paving machine in which the materials are mixed with asphalt and/or an aggregate before being deposited onto the roadway surface. This RX60 machine functions well as a front load road planing machine and as part of a cold in-place recycling system using a paving machine in conjunction with the roadworking machine. It is, however, incapable of performing a cold in-place recycling operation without a separate paving machine.

Roadworking machines have been proposed to effect milling and cold in-place recycling in a single operation. One such machine is disclosed in U.S. Pat. No. 4,317,642 to Wirtgen (the Wirtgen patent). The machine disclosed by the Wirtgen patent mills the upper layer of a roadway surface via a rotary drum and feeds the removed materials to a mixer mounted on the vehicle chassis where it is mixed with aggregate. The thus mixed materials are then spread onto the roadway surface and compacted by another machine.

The machine disclosed by Wirtgen suffers from marked drawbacks and disadvantages. For instance, it is incapable of adjusting the position of the mixer with respect to the chassis and thus has limited versatility. The machine disclosed by Wirtgen is also incapable of conversion to a front load road planing machine.

OBJECTS AND SUMMARY OF THE INVENTION

It is therefore an object of the invention to provide a method of converting a roadworking machine from front load road planing capability to cold in-place recycling capability.

In accordance with one aspect of the invention, this object is met by providing a machine having a chassis, a cutter mounted on the chassis and capable of removing an upper layer of a roadway surface, and a primary conveyor mounted on the chassis and having an inlet which is capable of receiving materials from the cutter drum and having an outlet. Subsequent steps include removing a secondary conveyor from a location on the chassis in which an inlet thereof is capable of receiving materials from the outlet of the primary conveyor, and then attaching a mixer to a location on the chassis in which an inlet thereof is capable of receiving materials from the outlet of the primary conveyor.

Preferably, the step of removing the secondary conveyor comprises removing the secondary conveyor from a pivot assembly on the chassis; and the step of attaching the mixer comprises mounting the mixer on the pivot assembly. In addition, the step of removing the secondary conveyor preferably further comprises detaching a yoke from the secondary conveyor, the yoke normally suspending an outer portion of the secondary conveyor from the chassis. In this case, the step of attaching the mixer further comprises attaching the yoke to an outer portion of the mixer so as to suspend the mixer from the chassis.

Another object off the invention is to provide a roadworking machine capable of being converted from front load road planing capability to cold in-place recycling capability.

In accordance with another aspect of the invention, this object is achieved by providing a roadworking machine comprising a chassis, a cutter mounted on the chassis and capable of removing an upper layer of a roadway surface, and means for selectively mounting both a conveyor and a mixer onto the chassis so as to receive materials from the cutter. The machine operates as a road planing machine when the conveyor is mounted on the chassis by the means for mounting and as a cold in-place recycling machine when the mixer is mounted on the chassis by the means for mounting.

Preferably, the means for mounting comprises a pivot assembly mounted on the chassis. The pivot assembly is capable of (1) selectively mounting the conveyor on the chassis for pivotal movement about a vertical axis, and (2) selectively mounting the mixer on the chassis for pivotal movement about the vertical axis. The pivot assembly preferably comprises a support cup fixedly mounted on the chassis and a pivot shaft rotatably mounted in the support cup, a support arm fixedly mounted on the pivot shaft, and a pivot arm extending from one of the pivot shaft and the support arm.

Means, connected to the pivot arm and to the chassis, are preferably provided for pivoting the pivot shaft about the vertical axis.

In order to enhance system versatility during cornering or the like, means are preferably provided for pivoting a selected one of the mixer and the conveyor about the horizontal axis.

Still another object of the invention is to provide a cold in-place recycling machine the discharge from which can be adjusted to accommodate varying operating conditions.

In accordance with yet another aspect of the invention, this object is achieved by providing a cold in-place recycling machine comprising a chassis, a cutter mounted on the chassis and capable of removing an upper layer of a roadway surface, and a mixer having an upper inlet and a lower outlet. The mixer is mounted on the chassis so as to be pivotable as a unit about at least one of a horizontal and a vertical axis.

Other objects, features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Resume

Pursuant to the invention, a roadworking machine can be converted from front load road planing capability to cold in-place recycling capability by replacing the secondary conveyor on the front end of the machine with a mixer such as a standard pugmill. The machine can be converted in the field simply by detaching the conveyor from a mounting assembly on the chassis and by attaching the pugmill to the same mounting assembly. The conveyor and pugmill are preferably attachable to the mounting assembly so as to be pivotable with respect to the chassis about both vertical and horizontal axes. The machine as thus constructed permits considerable versatility in both the discharge of milled materials from the secondary conveyor during front load planing and the discharge of recycled materials from the mixer during cold in-place recycling.

2. System Overview

Figure 1:
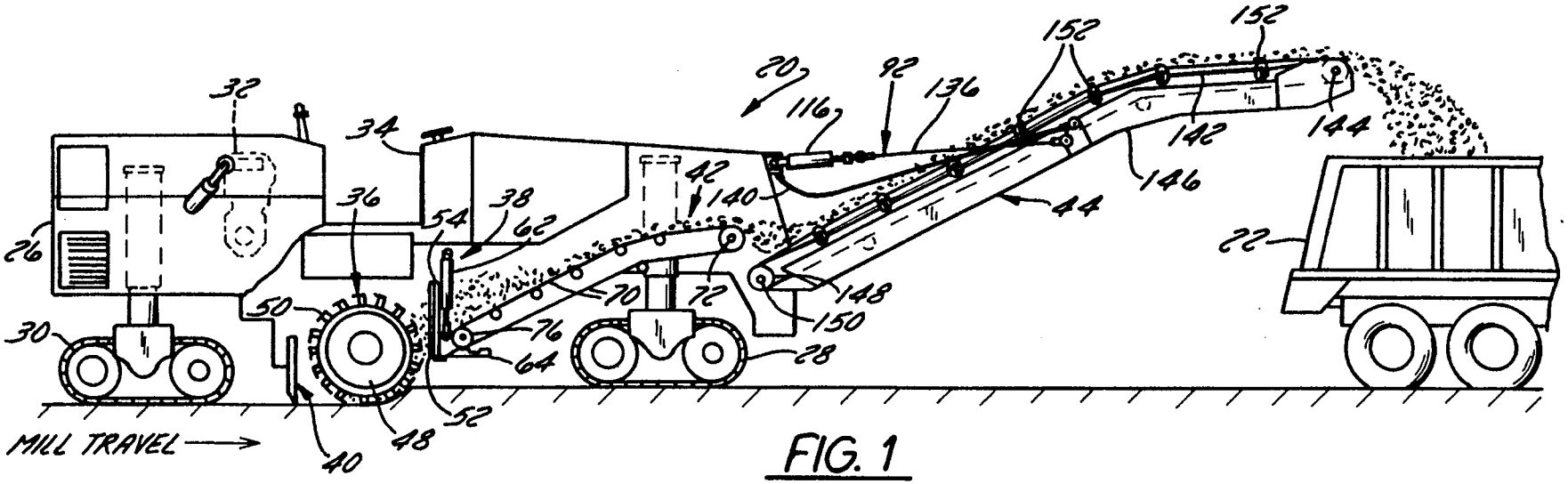
FIG. 1 is a side elevation view illustrating a roadworking machine constructed in accordance with a preferred embodiment of the present invention and performing a front load road planing operation.
Figure 2:
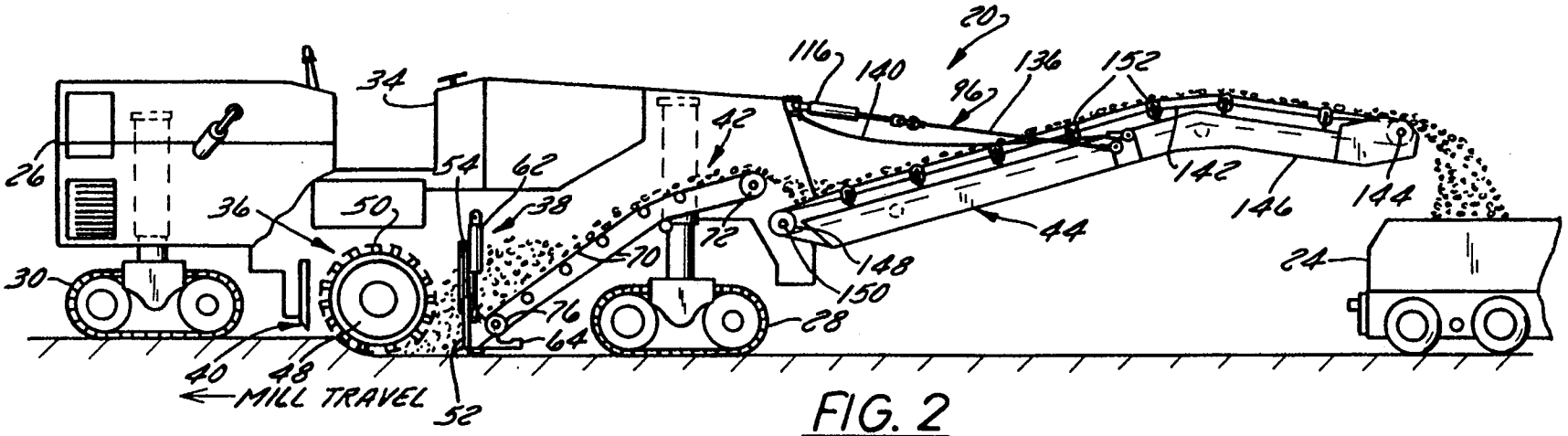
FIG. 2 is a side elevation view illustrating the machine of FIG. 1 performing a cold in-place recycling operation in conjunction with a standard paving machine.

Referring now to FIGS. 1–5, particularly 1 and 2, a roadworking machine 20 is illustrated which is capable of performing either a front load road planing operation in conjunction with a dump truck 22 or the like (FIG. 1) or a cold in-place recycling operation in conjunction with a paving machine 24 or the like (FIG. 2). Roadworking machine 20 is also convertible in the field from the configuration illustrated in FIGS. 1–5 to that illustrated in FIGS. 6–10 in which it is capable of performing a cold in-place recycling operation in a single step.

Roadworking machine 20 includes a chassis 26 mounted on front and rear tracks 28, 30 and driven by a conventional engine 32. Operation of the machine 20 is controlled by an operator positioned at an operator's station 34. Mounted on the chassis 26 are a cutter 36 for milling or planing the roadway surface, front and rear moldboard assemblies 38, 40 for leveling the planed surface, and a reclaimer assembly 42 for transporting the removed materials to a secondary device which may comprise either a conveyor assembly 44 as illustrated in FIGS. 1–5 or a mixer 46 as illustrated in FIGS. 6–10.

The cutter 36 may comprise any known device capable of milling the roadway surface when the roadworking machine 20 is traveling in either the reverse or forward directions. The preferred cutter comprises a rotary cutter drum 48 having a plurality of blades 50 mounted thereon which plane the roadway surface to the depths of the blades 50. The blades 50 engage the roadway surface in the upstroke when the roadworking machine 20 is traveling in the forward direction illustrated in FIG. 1 and in the downstroke when the machine is traveling in the reverse direction illustrated in FIG. 2. The construction and operation of cutting drum 48 is conventional and will not be described in further detail.

The roadworking machine 20 is designed to be able to plane in either direction of travel and to negotiate tight turns. Quartering ability is optimized by providing dual opposed front tracks 28 and a central rear track 30 with crab steer for close quarters work. Bi-directional planing is made possible by making the front and rear moldboard assemblies 38, 40 independently raisable and lowerable with respect to the chassis from a lowered, scraping position to a raised, inoperative position providing roadway clearance. Since these assemblies are preferably of identical construction, only front moldboard assembly 38 will be described.

Figure 3:
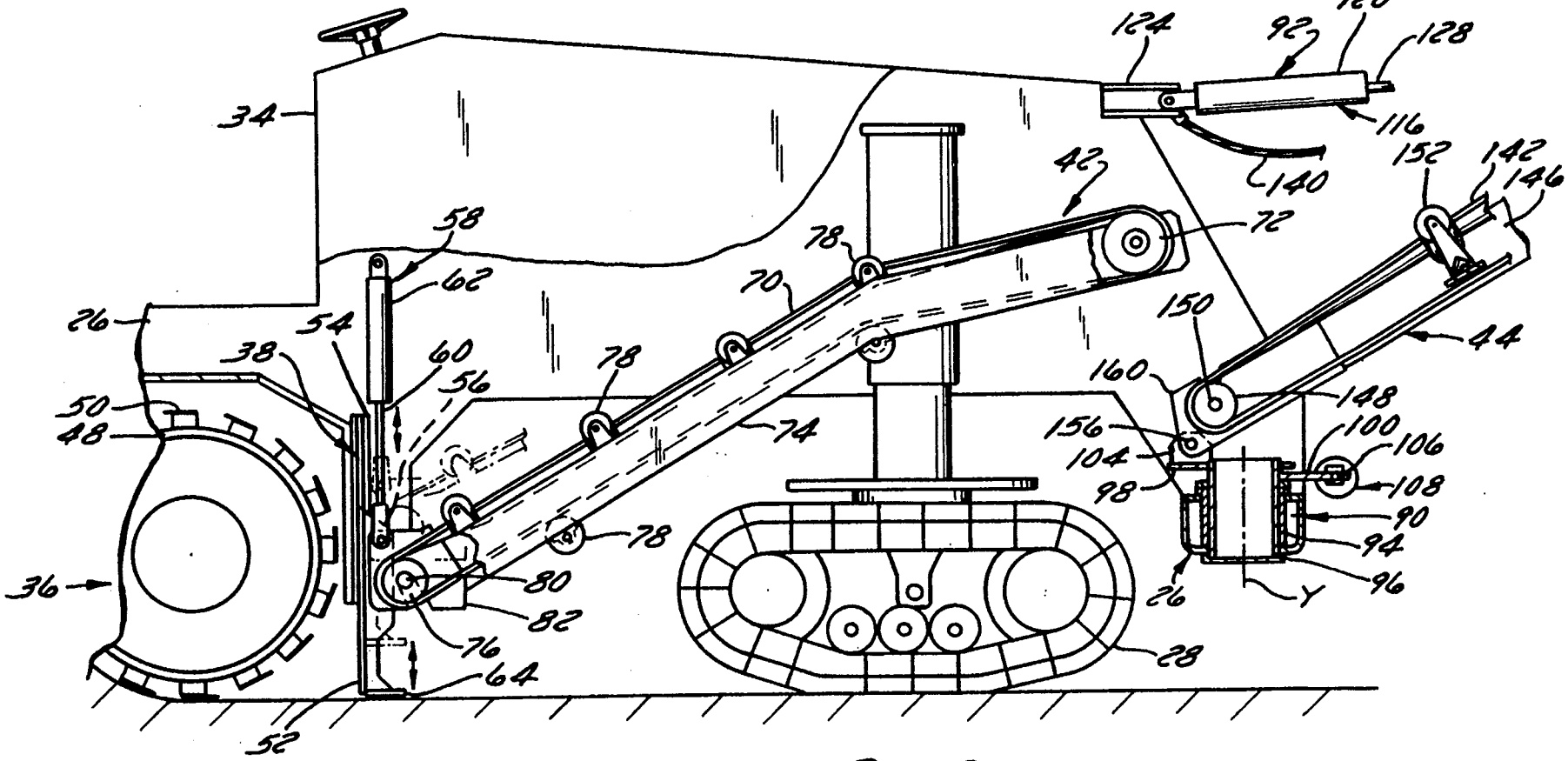
FIG. 3 is a side elevation view of a front portion of the machine of FIGS. 1 and 2 illustrating the raising and lowering of the front moldboard and primary conveyor assemblies.

Referring especially to FIG. 3, front moldboard assembly 38 includes a plate member 52 the opposed transverse edges of which are vertically slidably received in channel members 54, only one of which is illustrated in the drawings. A bracket 56 is attached to the front surface of the plate member 5.2 and receives the piston 60 of a moldboard lift cylinder arrangement 58, the cylinder 62 of which is attached to the chassis 26. A scraper 64 extends forwardly from the bottom edge of the plate member 52 so as to assure leveling of the planed surface. The position of the assembly 38 including the plate member 52 and of the scraper 64 can be vertically adjusted from its lowered, operational position in which it floats on the roadway surface to its upper, inoperative position by actuating the lift cylinder arrangement 58 as illustrated by the arrows in FIG. 3.

The reclaimer assembly 42 may comprise any device capable of transporting materials from the cutter 36 to the downstream device (either the conveyor assembly 44 or the mixer 46). Referring again to FIG. 3, the preferred assembly 42 illustrated in the drawings comprises a primary conveyor and includes a belt 70 driven by a hydrostatically powered drive pulley 72 mounted on the front end of a frame 74. Belt 70 is further supported on the frame 74 by a driven pulley 76 mounted on the rear end of the frame 74 and by a plurality of idler rollers 78 spaced along the frame 74. The driven pulley 76 is mounted on a pivot shaft 80 rotatably and pivotably received in a bracket 82 of the frame 74 which is in turn attached to the front bracket 56 of the front moldboard assembly 38.

Except for the secondary assembly located downstream of primary conveyor 42 and the associated mounting assembly, roadworking machine 20 as thus far described is essentially identical to the Astec RX60 machine described above and, accordingly, will not be described in greater detail.

Located at the front end of the chassis 26 is a mounting assembly permitting the field conversion of the roadworking machine 20 from front load road planing capability to cold in-place recycling capability. A preferred mounting assembly and the associated secondary devices will now be detailed.

3. Mounting Assembly for Permitting Field Conversion

The mounting assembly is designed to (1) permit the attachment of the secondary device (the secondary conveyor 44 or mixer 46) to the chassis 26 for both horizontal and vertical pivoting with respect thereto and (2) permit the field replacement of one secondary device with another. A number of mounting assemblies could achieve these objectives. The illustrated assembly is, however, preferred for reliability and simplicity and includes a pivot assembly 90 and a yoke 92. The pivot assembly 90 supports the rear end of the associated secondary device 44 or 46 on the lower portion of chassis 26, and the yoke 92 suspends the secondary device from the upper portion of chassis 26. These devices and their connection to and operation with the secondary conveyor assembly 44 will now be detailed.

Figure 4:
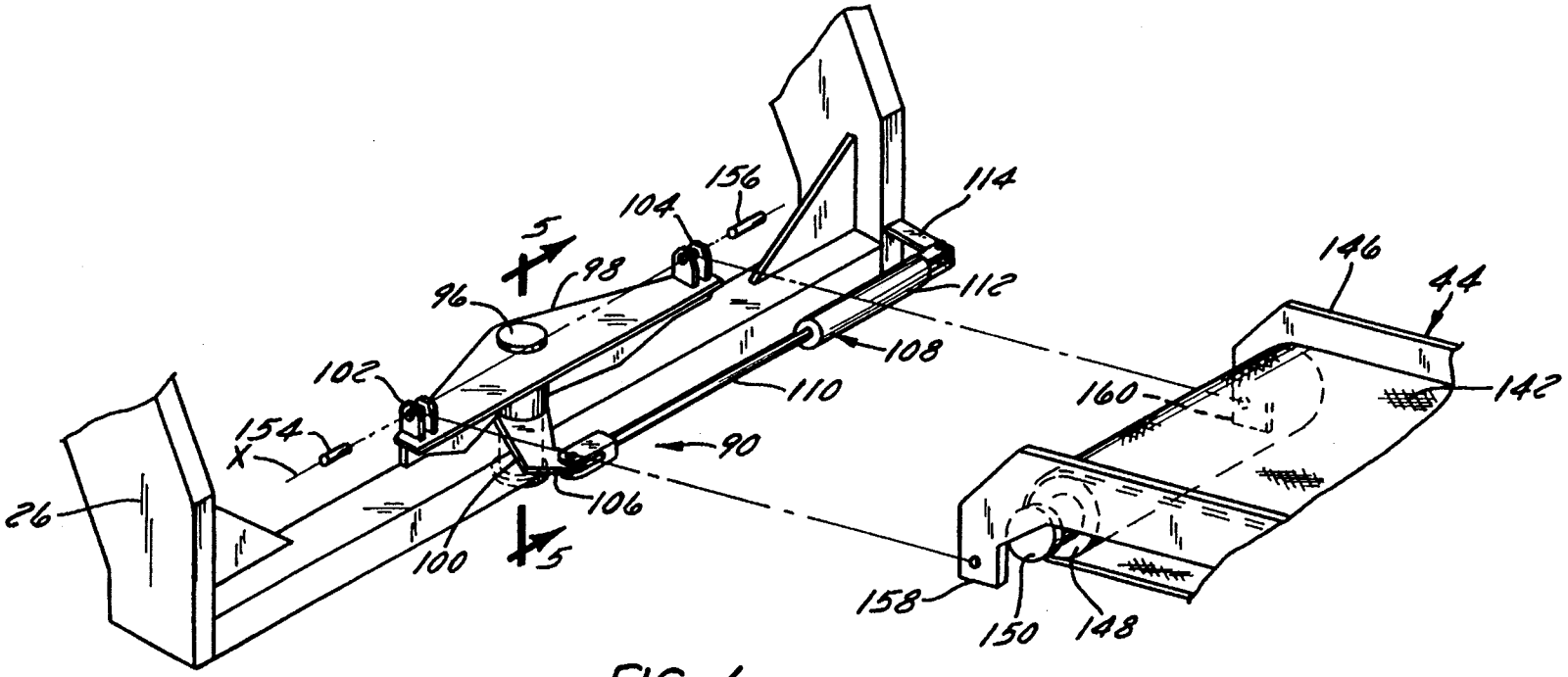
FIG. 4 is a perspective view illustrating the detachment of the secondary conveyor assembly from the chassis of the machine of FIGS. 1–3 to begin conversion from front load road planing capability to cold in-place recycling capability.
Figure 5:
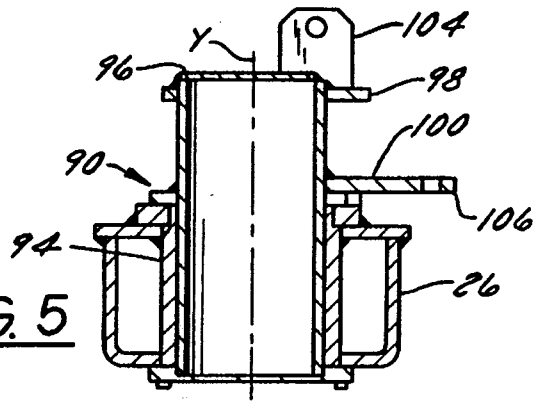
FIG. 5 is a sectional elevation view taken along lines 5—5 in FIG. 4.
Figure 6:
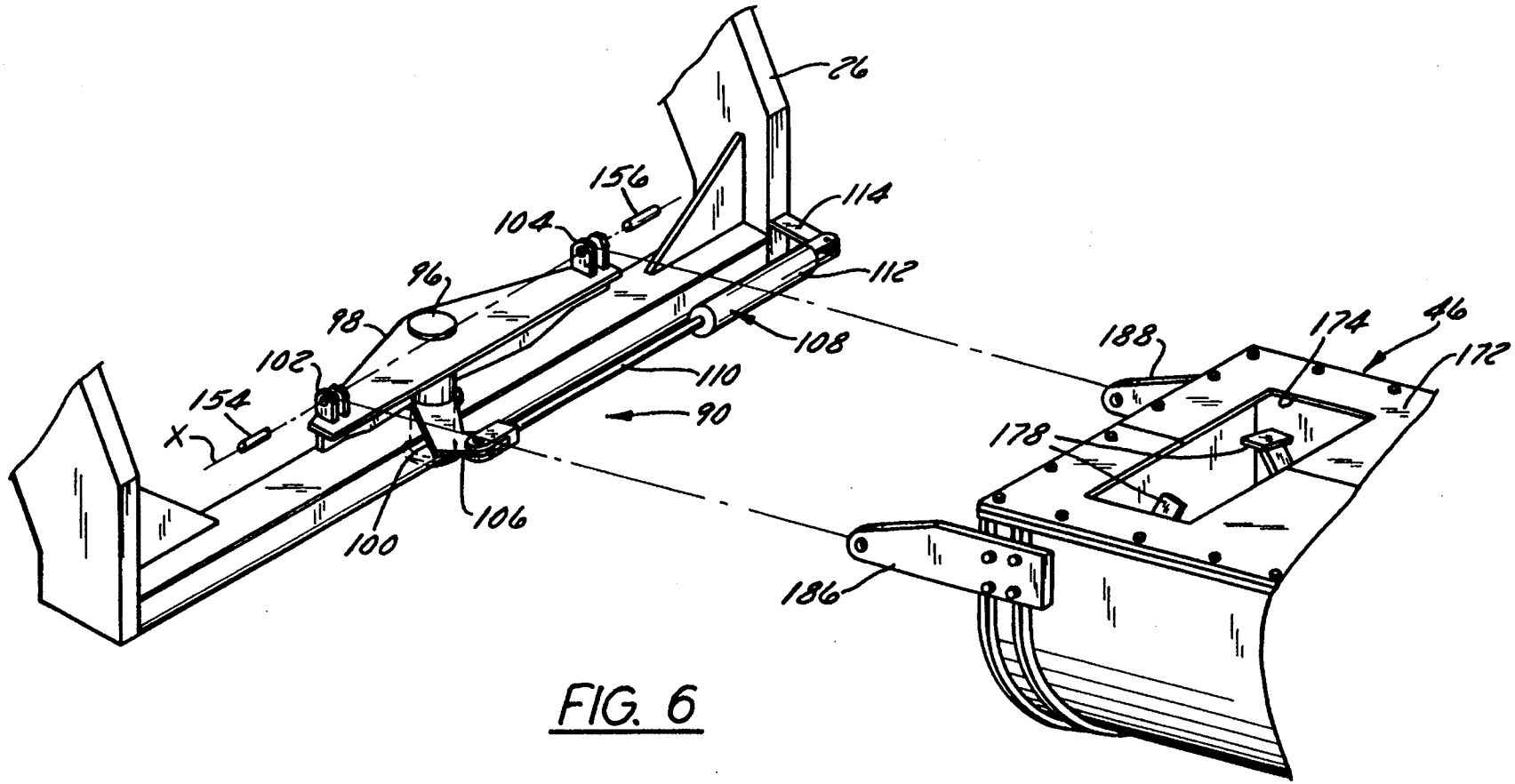
FIG. 6 is a perspective view illustrating the connection of a pugmill to the chassis of the machine of FIGS. 1–3 to complete conversion from front load road planing capability to cold in-place recycling capability.

Referring now to FIGS. 1–5, 8, and 9, the pivot assembly 90 includes a support cup 94 mounted on the chassis 26 and a pivot shaft 96 received in the support cup 94 so as to be rotatable about a vertical axis Y (FIGS. 3 and 5). The pivot shaft 96 receives a support arm 98 near an upper end thereof and a pivot arm 100 between the support arm 98 and the chassis 26. The support arm 98 is mounted on the pivot shaft 96 and has upwardly extending clevises 102, 104 near the outer ends thereof for pivotally supporting the conveyor assembly 44. The pivot arm 100 terminates in an ear 106 pivotally connected to the piston 110 of a pivot cylinder arrangement 108. A cylinder 112 of the pivot cylinder arrangement 108 is pivotally connected to a pivot mount 114 fixed to the chassis 26.

Figure 9:
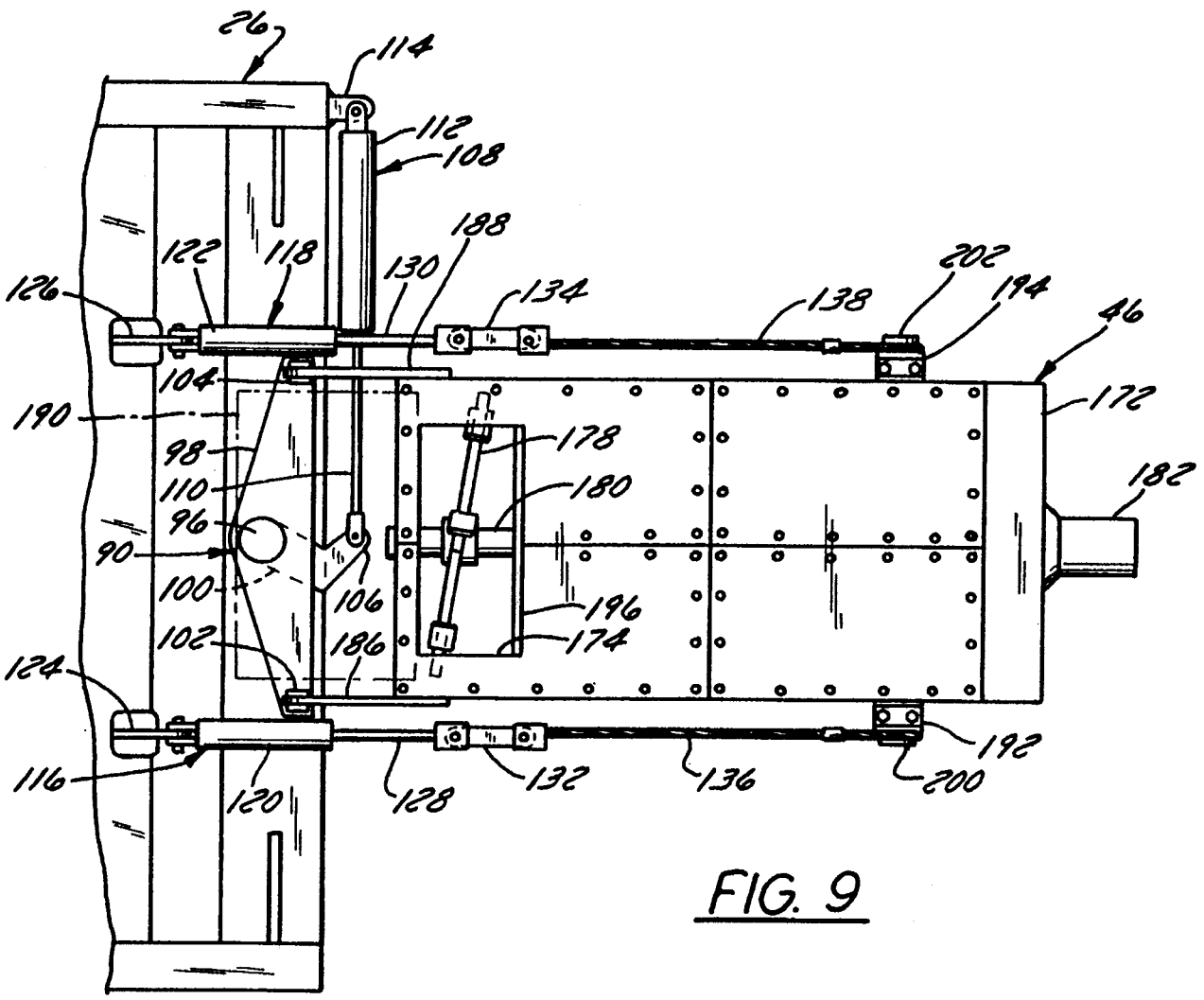
FIG. 9 is a top plan view of the pugmill and rear end of the roadworking machine.
Figure 10:
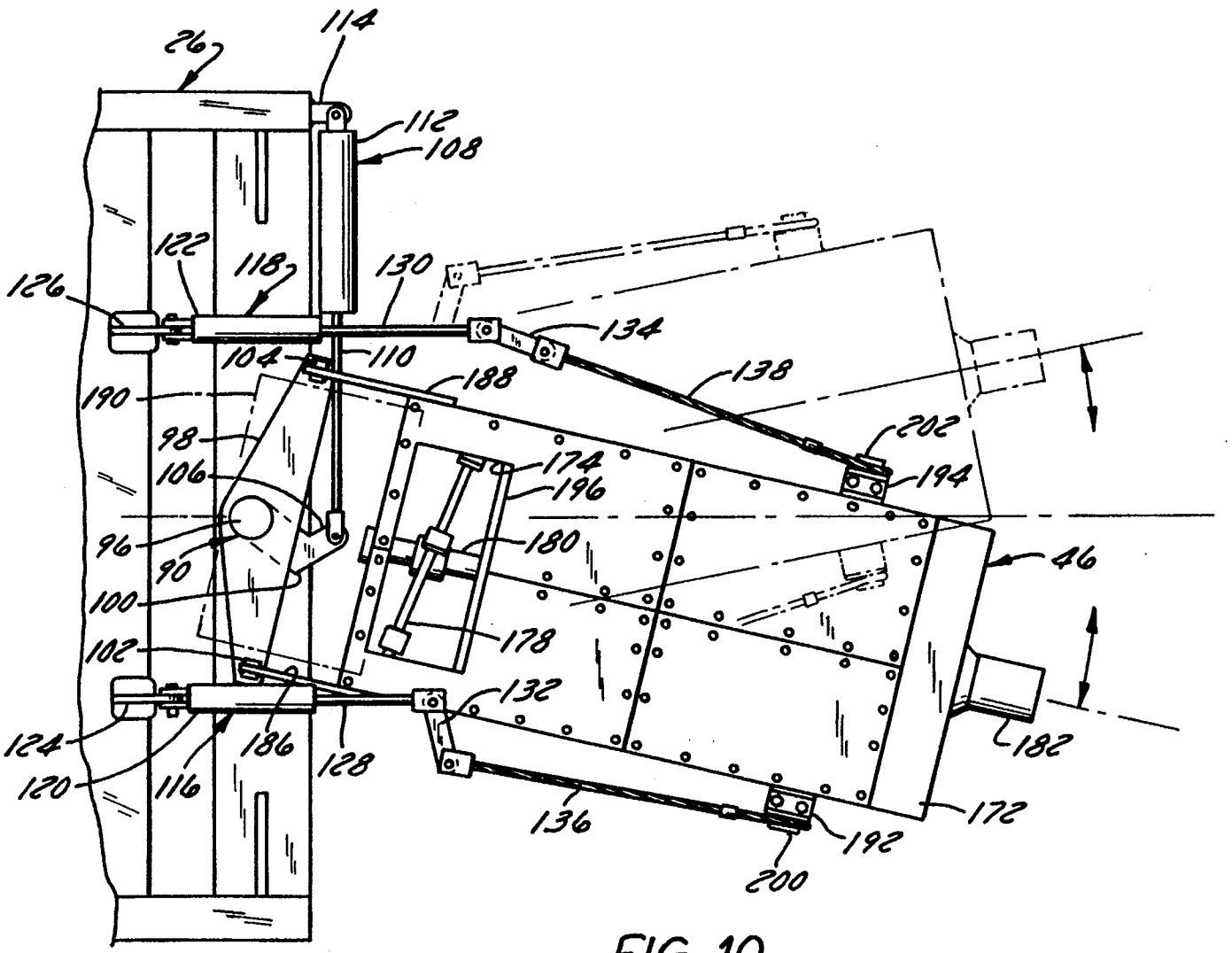
FIG. 10 corresponds to FIG. 9 and illustrates the manner in which the pugmill is pivotable about a vertical axis.

Yoke 92 is formed from laterally opposed lift cylinder arrangements 116, 118 and associated cable assemblies. Each lift cylinder arrangement is identical and includes (1) a cylinder 120, 122 pivotally connected to a lift cylinder mount 124, 126 extending forwardly from an upper front portion of the chassis 26, and (2) a piston 128, 130 pivotally connected to a first end of a pivot link 132, 134 (FIGS. 3, 9 and 10). The opposed end of each pivot link 132, 134 is connected to the first end of a cable 136, 138, the second end of which is connected to a respective side of a generally medial portion of the secondary conveyor 44. A safety cable 140 also extends from each lift cylinder mount 124, 126 to the secondary conveyor assembly 44.

Referring to FIGS. 1–4, secondary conveyor assembly 44 is conventional and includes a belt 142 driven by a hydrostatically powered drive pulley 144 located at the upper end of the conveyor and supported on a frame 146. Belt 142 is further supported on the frame 146 by a driven pulley 148 mounted on the lower end of the frame 146 by a shaft 150, and by a plurality of idler rollers 152 spaced along the frame 146. The conveyor assembly 44 is attached to the chassis 26 by: 1) pivot pins 154, 156 connecting depending arms 158, 160 of the frame 146 to the clevises 102, 104 (FIG. 4); and 2) the second ends of cables 136, 38, and 140. The pivot pins 154, 156 permit the frame 146 to pivot vertically about a horizontal axis X (FIG. 4).

To use the roadworking machine 20 as a front load road planer, the front moldboard assembly 38 is raised and the rear moldboard assembly 40 lowered as illustrated in FIG. 1 and the cutter drum 48 rotated to remove the top layer of the roadway surface as the machine 20 travels in a forward direction. The removed materials are fed from the cutter drum 48 to the secondary conveyor assembly 44 by the primary conveyor assembly 42, and are then discharged by the secondary conveyor assembly into the dump truck 22 traveling in front of the machine. When used in this mode, lift cylinders 116, 118 are retracted to raise the front end of secondary conveyor assembly 44 to a height sufficient for the discharge of materials into the relatively high dump truck 22.

The roadworking machine 20 having conveyor assembly 44 mounted thereon can also be used in a cold in-place recycling system in conjunction with a paving machine 24 by lowering the front moldboard assembly 38 and raising the rear moldboard assembly 40 and rotating the cutter drum 48 as the machine 20 travels in the reverse direction illustrated in FIG. 2. The removed materials are fed to the secondary conveyor assembly 44 by the primary conveyor assembly 42 and then into the paving machine 24 by the secondary conveyor assembly 44. The front end of the secondary conveyor assembly 44 is lowered by extension of the lift cylinders 114, 116 so that the discharge end of the secondary conveyor assembly 44 is immediately above the relatively low paving machine 24. Raising and lowering the assembly 44 in either mode is made possible by pivoting of the arms 158, 160 about the axis X defined by the pivot pins 154, 156. The secondary conveyor assembly 44 can also be pivoted in either mode about the vertical axis Y by actuating the hydraulic pivot-cylinder 108 to rotate the pivot shaft 96 and the support arm 98 about cup 94, thereby enabling the system to better negotiate corners or curves in the road.

4. Conversion to Integral Cold In-Place Recycling Machine and Operation of Integral Cold In-Place Recycling Machine Referring now to FIGS. 4–10, the roadworking machine 20 can be quickly converted into an integral cold in-place recycling machine by replacing the secondary conveyor 44 with the mixer 46. The converted machine 20, illustrated in FIGS. 6–10, feeds recycled materials into the mixer 46, where it is mixed with liquid asphalt from a tank 170 (FIG. 7) and discharged back onto the roadway surface. The construction of the mixer 46, the replacement of the secondary conveyor assembly 44 with the mixer 46, and the operation of the converted machine will now be described.

The mixer 46 preferably comprises a conventional single screw pugmill converted for mounting on the roadworking machine 20. Pugmill 46 includes a housing 172 having an upper inlet 174 at the rear end thereof for receiving removed materials and liquid asphalt, and a lower outlet 176 at the front end thereof for discharging the cold mixture formed by the pugmill onto the roadway surface. A rotatable shaft 180 is mounted on the housing 172, is driven to rotate by a conventional hydrostatic drive 182, and receives a plurality of hammers 178 for mixing materials within the housing 172. The hydrostatic drive 180 is supplied with hydraulic fluid by hydraulic hoses 184 in a manner which is, per se, well known. At least one of the drives 180 and associated devices 184, 196, and 198 is omitted from each of FIGS. 6, 7, 9, and 10 for the sake of clarity.

To adapt pugmill 46 for use with machine 20, mounting arms 186, 188, a rear chute 190, front yoke brackets 192, 194, and a plate 196 are provided on the pugmill 46 for mounting the pugmill 46 on the roadworking machine 20, for permitting the use of the roadworking machine 20 and pugmill 46 as a cold in-place recycling machine, and for forming a backstop for chute 190 and a support for a hydrostatic cylinder 198, respectively. The arms 186, 188 extend rearwardly from the rear end of the pugmill housing 172 and are pivotally connectable to the clevises 102, 104 of the pivot assembly 90 by the pivot pins 154, 156. The chute 190 extends upwardly and rearwardly from the upper surface of the pugmill housing 172 and has an inlet positionable adjacent the discharge end of the primary conveyor assembly 42 and an outlet emptying into the inlet 174 of the pugmill housing 172. The front yoke brackets 192, 194 extend upwardly from the front portion of the pugmill housing 172 and present pins 200, 202 for receiving the front loop of the cables 136, 138.

To convert the roadworking machine 20 from one capable of front load road planing or of feeding materials to a paving machine of a cold in-place recycling system to one capable of performing an entire cold in-place recycling operation without a separate paving machine, the secondary conveyor assembly 44 is first removed by detaching the front ends of the yoke cables 136 and 138 and the safety cables 140 from the secondary conveyor frame 146 and by removing the pins 154, 156 connecting the arms 158 and 160 of assembly 44 to the pivot assembly 90. The pugmill 46 is then attached to the chassis 26 of the roadworking machine 20 simply by attaching the yoke cables 136, 138 to the pins 200, 202 of the yoke arms 192, 194 and by inserting the pins 154, 156 through the clevises 102, 104 and the support arms 186, 188. Cables 140, though not illustrated in FIGS. 6–10, could also be attached to the yoke arms 192, 194. Finally, tank 170 is mounted on chassis 26, and a feed line 204 is positioned so as to be capable of feeding liquid asphalt from the tank 170 to the inlet 174 of the pugmill housing 172.

Figure 7:
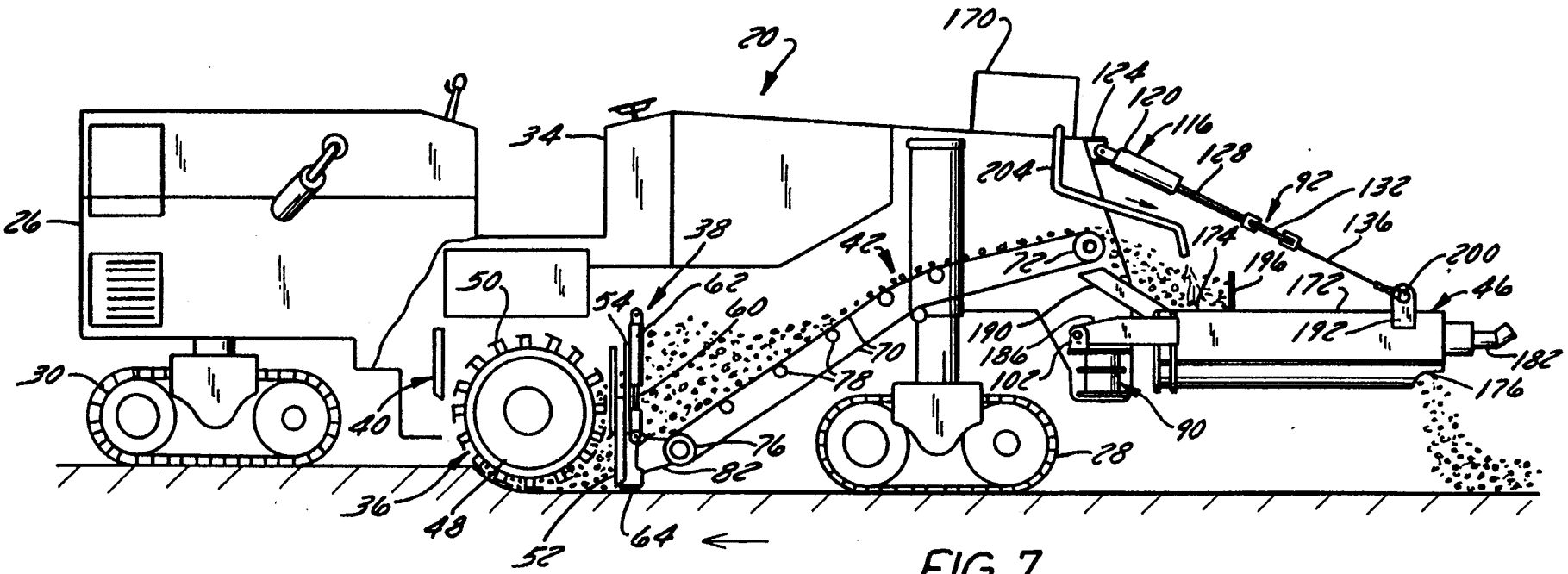
FIG. 7 is a side elevation view of the machine of FIGS. 1–3 after the secondary conveyor has been replaced with the pugmill and performing a cold in-place recycling operation.

A cold in-place recycling operation can then be initiated by raising the rear moldboard assembly 40, by lowering the front moldboard and primary conveyor assemblies 36 and 42, and by driving the roadworking machine 20 in the reverse direction as illustrated in FIG. 7. The cutter drum 48 is then rotated to mill the upper layer of the roadway surface. The removed materials are conveyed from the cutting drum 48 to the inlet 174 of pugmill 46 by the primary conveyor 42 and chute 190 and mixed with liquid asphalt supplied from the tank 170 to form a cold recycled mixture. The thus formed mixture is then fed out of the outlet 176 of the pugmill housing 172 and onto the roadway surface.

Figure 8:
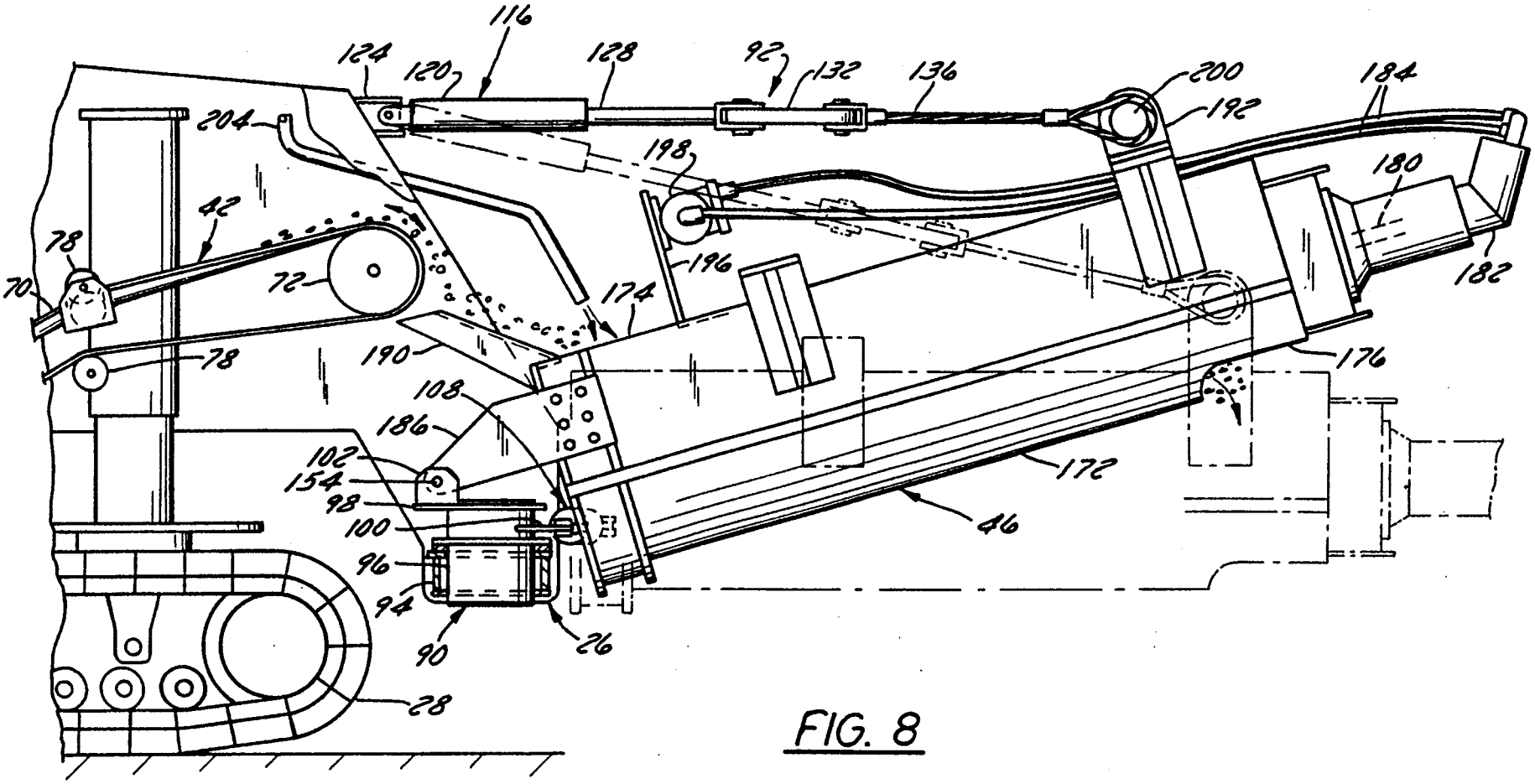
FIG. 8 is a side elevation view corresponding to FIG. 7 and illustrating the manner in which the pugmill is pivotable about a horizontal axis.

A distinct advantage of the present invention when converted to cold in-place recycling capability, apart from the fact that cold in-place recycling can be performed without requiring a separate paving machine, is that the discharge of materials from the mixer 46 can be controlled. That is, the height of the outlet 176 of the pugmill housing 172 can be adjusted vertically as illustrated in FIG. 8 by extending or retracting the lift cylinders 116, 118 to pivot the pugmill 46 about the horizontal axis X defined by the pivot pins 154, 156. The pugmill 46 can also be pivoted about the vertical axis Y defined by the pivot shaft 96 by actuating the pivot cylinder arrangement 108. Pivoting the pugmill 46 vertically about the horizontal axis X permits the system to accommodate sudden and marked variations in the roadway surface occurring, e.g. upon steep and sudden upgrades or downgrades. Pivoting the pugmill 46 horizontally about the vertical axis Y permits the machine 20 to accommodate corners or sharp curves in the road. The system is thus considerably more versatile than conventional paving machines, the horizontal versatility of which is usually limited by the turning radius of the paving machine and the vertical versatility of which is often nonexistent.

Many changes and modifications could be made to the invention without departing from the spirit thereof. The scope of such changes will become apparent from the appended claims.

I claim:

1. A method of converting a machine from front load road planing capability to cold in-place recycling capability, said method comprising:

A. providing a machine having (1) a chassis, (2) a cutter mounted on said chassis and capable of removing an upper layer of a roadway surface, and (3) a primary conveyor mounted on said chassis and having an inlet which is capable of receiving materials from said cutter drum and having an outlet;

B. removing a secondary conveyor from a location on said chassis in which an inlet thereof is capable of receiving materials from said outlet of said primary conveyor; and then C. attaching a mixer to a location on said chassis in which an inlet thereof is capable of receiving materials from said outlet of said primary conveyor.

2. A method as defined in claim 1, wherein

A. said step of removing said secondary conveyor comprises removing said secondary conveyor from a pivot assembly on said chassis; and B. said step of attaching said mixer comprises mounting said mixer on said pivot assembly.

3. A method as defined in claim 2, wherein said step of removing said secondary conveyor further comprises removing opposed arms from clevises which form part of said pivot assembly, said arms extending downwardly from an inlet end of said secondary conveyor.

4. A method as defined in claim 2, wherein said step of attaching said mixer comprises attaching opposed arms to clevises which form part of said pivot assembly, said arms extending generally horizontally from an upper portion of an inlet end of said mixer.

5. A method as defined in claim 2, wherein

A. said step of removing said secondary conveyor further comprises detaching a yoke from said secondary conveyor, said yoke normally suspending an outer portion of said secondary conveyor from said chassis; and B. said step of attaching said mixer further comprises attaching said yoke to an outer portion of said mixer so as to suspend said mixer from said chassis.

6. A method comprising:

replacing a conveyor of a roadworking machine with a mixer, thereby converting said roadworking machine from front load road planing capability to a cold in-place recycling capability.

7. A machine, comprising

A. a chassis;

B. a cutter mounted on said chassis and capable of removing an upper layer of a roadway surface; and C. means for selectively mounting both a conveyor and a mixer onto said chassis so as to receive materials from said cutter, said machine operating as a road planing machine when said conveyor is mounted on said chassis by said means for mounting and as a cold in-place recycling machine when said mixer is mounted on said chassis by said means for mounting.

8. A machine as defined in claim 7, wherein said cutter comprises a cutter drum rotatably mounted on said chassis, and further comprising first and second moldboard assemblies located in front of and behind said cutter drum, respectively, each of said front and rear moldboard assemblies being independently raisable and lowerable with respect to said chassis.

9. A machine as defined in claim 8, wherein said cutter drum is capable of operating when said machine is driven in both a forward direction and a reverse direction, said front moldboard assembly being raised and said rear moldboard assembly lowered when said machine travels in said forward direction, and said rear moldboard assembly being raised and said front moldboard assembly lowered when said machine travels in said reverse direction.

10. A machine as defined in claim 9, wherein said conveyor comprises a secondary conveyor, and further comprising a primary conveyor having a rear end capable of receiving materials from said cutter drum and a front end capable of delivering materials to said secondary conveyor, said rear end being coupled to said front moldboard assembly so as to raisable and lowerable therewith.

11. A machine as defined in claim 7, wherein said means for mounting comprises a pivot assembly mounted on said chassis, said pivot assembly being capable of (1) selectively mounting said conveyor on said chassis for pivotal movement about a vertical axis, and (2) selectively mounting said mixer on said chassis for pivotal movement about said vertical axis.

12. A machine as defined in claim 11, wherein said pivot assembly comprises a support cup fixedly mounted on said chassis and a pivot shaft rotatably mounted in said support cup.

13. A machine as defined in claim 12, wherein said pivot assembly further comprises a support arm fixedly mounted on said pivot shaft, and a pivot arm extending from one of said pivot shaft and said support arm, and further comprising means, connected to said pivot arm and to said chassis, for pivoting said pivot shaft about said vertical axis.

14. A machine as defined in claim 13, further comprising means for connecting a selected one of said mixer and said conveyor to said support arm so as to permit pivoting of said selected one about a horizontal axis.

15. A machine as defined in claim 14, further comprising means for pivoting said selected one about said horizontal axis.

16. A machine as defined in Claim 15, wherein said means for pivoting comprises a hydraulic lift cylinder.

17. A cold in-place recycling machine comprising

A. a chassis;

B. a cutter mounted on said chassis and capable of removing an upper layer of a roadway surface; and C. a mixer having an upper inlet and a lower outlet, said mixer being mounted on said chassis so as to be pivotable as a unit about at least one of a horizontal and a vertical axis.

18. A machine as defined in claim 17, further comprising a conveyor having an inlet capable of receiving materials from said cutter and an outlet capable of feeding materials into said inlet of said mixer.

19. A machine as defined in claim 17, further comprising a pivot assembly connecting said mixer to said chassis for pivotable movement about both said vertical and horizontal axes.

20. A machine as defined in claim 19, wherein said pivot assembly comprises a support cup fixedly mounted on said chassis and a pivot shaft rotatably mounted in said support cup.

21. A machine as defined in claim 20, wherein said pivot assembly further comprises a support arm fixedly mounted on said pivot shaft and a pivot arm extending from one of said pivot shaft and said support arm, and further comprising means, connected to said pivot arm and to said chassis, for pivoting said pivot shaft and said support arm about said vertical axis.

22. A machine as defined in claim 21, further comprising means, connected to said mixer and to said chassis, for pivoting said mixer about said horizontal axis.

* * * * *